United States Patent [19]

Kanne et al.

[11] 4,125,260

[45] Nov. 14, 1978

[54] TUBULAR GOLF SHAFT OF STAINLESS STEEL

[75] Inventors: John Kanne, Ashtabula, Ohio; Harry E. Deverell, Natrona Heights, Pa.

[73] Assignee: True Temper Corporation, Cleveland, Ohio

[21] Appl. No.: 687,153

[22] Filed: May 17, 1976

[51] Int. Cl.[2] ..... A63B 53/12

[52] U.S. Cl. ..... 273/80 R; 75/124; 75/128 T; 75/128 W; 148/37; 428/586

[58] Field of Search ..... 29/180 GC; 273/80 B, 273/80 R; 75/128 T, 128 W, 124; 148/37; 428/586

[56] References Cited

U.S. PATENT DOCUMENTS

| | | | |
|---|---|---|---|
| 3,262,823 | 7/1966 | Sadowski et al. | 75/128 T |
| 3,342,590 | 9/1967 | Bieber | 75/124 |
| 3,556,776 | 1/1971 | Clarke, Jr. et al. | 75/128 W |
| 3,594,158 | 7/1971 | Sadowski | 75/128 W |
| 3,759,757 | 9/1973 | Petty | 75/128 W |
| 3,769,003 | 10/1973 | Kenyon | 75/128 W |
| 3,795,507 | 3/1974 | Allen | 75/124 |

OTHER PUBLICATIONS

Ken Smith, "Golf Clubs," 1969, pp. 8 and 10.

*Primary Examiner*—Arthur J. Steiner
*Attorney, Agent, or Firm*—J. H. Slough

[57] ABSTRACT

An improved precipitation hardening or maraging stainless steel for use in Tubular Sporting Implements, particularly golf shafts containing chromium, molybdenum and nickel, the sum of said chromium, molybdenum and nickel being at least 18% and not exceeding 25%, at least one element selected from the group consisting of aluminum and titanium in a maximum of 1.30%, carbon in a maximum amount of 0.06%, manganese 0.50% maximum, silicon 0.30% maximum, the balance being essentially iron and incidental impurities.

2 Claims, 2 Drawing Figures

TENSILE CURVES FOR ANNEALED AND AGED AND COLD WORKED AND AGED TEST "A"

TUBULAR GOLF SHAFT OF STAINLESS STEEL

This invention relates to an improved composition of material for use in tubular sporting implements and relates more particularly to stainless steel to be used in golf shafts or the like.

The invention is susceptible to use in game rackets, ski poles, fishing rods, or other sporting elements other than golf shafts employing tubular framing, poles or rods.

Historically, golf club shafts have been made from a high strength carbon steel. The carbon steel production process in the industry converts a large diameter heavy wall thickness purchased tubing to the small diameter and thin wall which constitute golf shafts, forms the tapered shaft from straight lengths of tubing, heat treats the shafts to high strength and hardness and chrome plates the shafts to provide corrosion resistance in service and a smooth appearance. The low work hardening characteristics of carbon steel have allowed tubes to be drawn more than one draw reduction without being made too hard or brittle to handle; however, due to the large total number of draw passes required to produce golf shaft dimensions from starting stock, in-process annealing is required. Annealing, facilities for the carbon steel products for use in golf shafts have commonly produced temperatures to perhaps 1750° F. and controlled slow cooling to prevent martensitic transformation. Normal operations require furnace temperatures between an approximate 1200° F. and 1600° F.

Once drawn to small uniform diameter and thin wall, carbon steel is tapered from the uniform diameter of drawn tubing to a straight or "stepped" taper and in "stepped" golf shafts normally by a series of small diameter reductions accomplished by a number of small "sinks" or drawing reductions of diameter with or without reduction of wall thickness. Presses utilized to perform such a tapering operation commonly perform the "sinks" by pushing cut tube blanks vertically down into and through a die set to "sink" the tube to within a carefully measured length from the top, withdrawing the sunk tube from the die, indexing around to another die and repeating the sinking operation to place another step further down from the top of the blank. The first sink covers nearly the entire blank length, the second performs an additional reduction on a shorter length of material already sunk once. In this manner, steps can be put onto a blank on one press to form a shaft of greatly different diameter at top and bottom. Although the individual steps are small reductions, the effect of a large number of small reductions is a large reduction and, if the material were of low ductility or possessed of a high work hardening quality, the tapering operation would experience process difficulties in the final reductions. Carbon steel, as has been mentioned above, is a low work hardening material. Although game rackets are commonly not provided with steps, the same may be provided with uniform or tapering wall sections and non-uniform cross-sections. The same are bent into loop form and extend into terminal reach members.

Thus it is apparent that the metallurgical qualities of ductility, or ability to be drawn and formed, and work hardening, or increase of strength upon deformation are important qualities in production of golf club shafts and other sporting implements including game rackets. Other qualities are similarly important as evidenced by experience with golf shafts made from an aluminum alloy. This material required thicker diameter and wall to compensate for much lower elastic modulus and strength than steel. The qualities of "stiffness" and "flex" are designed into a tubular member based on strength and modulus qualities. The low density of aluminum in golf shafts allowed these changes with low weight maintained, however. Thus the metallurgical qualities of strength, or ability to support high loads per unit of cross-sectional area, elastic modulus (stress per unit elongation or measure of resistance to elongation under stress), and density (or weight per unit volume) are important also.

Since the carbon steel shafts for golf clubs require chromium plating to prevent rusting, corrosion resistance is also an important metallurgical quality in a golf shaft.

The present invention involves the use of stainless steel of a strength equivalent to and possibly higher than that of high strength carbon steel and eliminating the chrome plating required for carbon steel. This combination of properties will permit the manufacture of a relatively lighter weight tubular golf club shaft which is highly desirable in that theoretically greater head speeds can be obtained. In choosing a stainless steel suitable for the uses indicated, precipitation hardening stainless steels were examined. It was found that a conventional martensitic alloy like AISI 440A, B or C, if employed, could develop extremely high tensile strength but could never be made sufficiently ductile to be drawn through the large total number of draw passes required, or to be step tapered through large total reductions. Decarburization, or loss of carbon during heat treating operations, also could be a problem in use of alloys which harden from iron-carbon martensite. Other age-hardening stainless steels were examined. Some, however, developed very high strengths very quickly with deformation (high work hardening) and were unsuited for fabrication. At one time, a low carbon martensitic precipitation hardening alloy, Almar 362 (trade name of Allegheny-Ludlum Steel Corporation) was studied. This alloy precipitation hardens through a low temperature treatment differing from that of carbon steel. The hardening does not depend on carbon to occur, thus decarburization is not a problem. An added feature not shared with carbon steel or aluminum is the ability of such alloy to permit the hardening reaction to occur while maintaining the strength increasing effects of drawing and tapering in the shaft, thus producing very high strength levels. However, the fabrication of Almar 362 shafts indicated that the metallurgical quality of toughness, or ability to absorb considerable energy before breaking, was lower than desired. Testing of such shafts showed an undesired sensitivity to breakage in laboratory toughness tests.

The above examples illustrate some of the metallurgy underlying the production of a golf club shaft or other sporting implements, and the metallurgical criteria including the properties required in combination with additional technology involved in producing desired flex, stiffness, design and swing weight of shafts. Like a jet engine, or a chemical plant, substantial technology underlies the design of a golf club shaft. A partial list of the metallurgical qualities to be considered are, again:

(1) ductility;
(2) work hardening;
(3) strength;
(4) elastic modulus;
(5) density;
(6) corrosion resistance;
(7) toughness.

In the precipitation hardening or maraging group, many stainless steels are acceptable as far as the qualities 1, 2, 4, 5 and 6 listed above.

Figure 1:
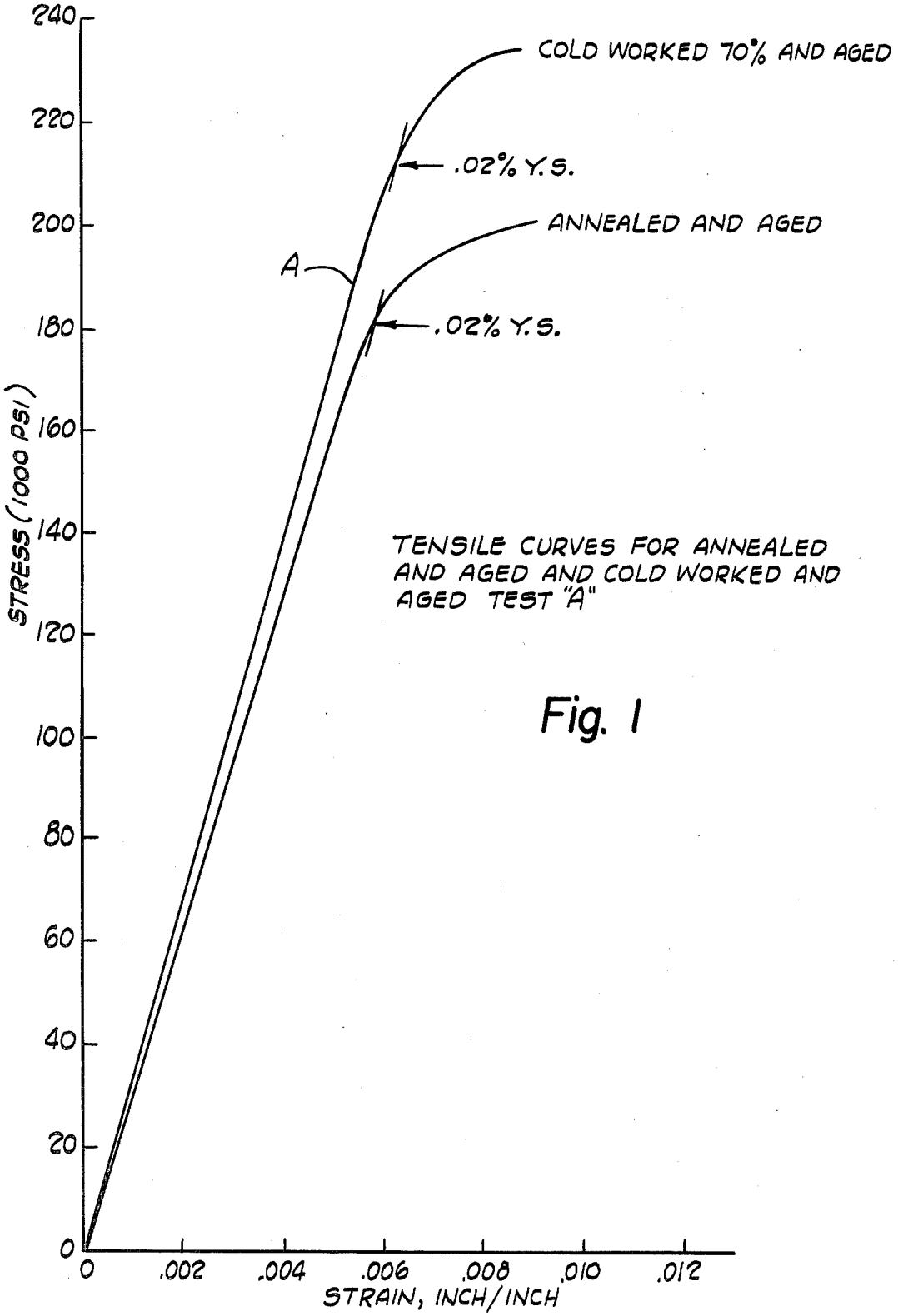
FIG. 1 is a tensile strength graph for materials of the present invention.

The strength and toughness qualities deserve special consideration. Strength as measured in a conventional tensile test indicates that about 200,000 psi 0.02% offset yield strength is required to produce an acceptably strong golf shaft as measured by the permanent deflection test on tip ends of golf shafts. This 200,000 psi 0.02% yield strength produces, in selected precipitation hardening stainless steels, about a 220,000 psi ultimate tensile strength. FIG. 1 serves to illustrate this for a stainless steel of this invention and further serves to illustrate the ability to produce additional strength from hardening cold worked material. In the Almar 362 work described hereinbefore, a minimum toughness of about 550 in-lbs/in$^2$ was required. 600 in-lbs/in$^2$ minimum was desired as a safety factor. Somewhere in the 400–450 area, a breakage problem begins with the Almar 362 progressively becomes worse and the toughness decreases. The measure of toughness employed is an aerospace criterion defined as work (in-lbs) to create a unit area (in.$^2$) of new surface when breaking a fatigue cracked specimen in an impact test. In this work, toughness is measured transverse to the axis of the tube or transverse to the rolling direction of the strip. The depth of crack is measured and subtracted from the cross section of the specimen. The impact strength is measured, then divided by area to yield the work to create a unit area of new surface. High values indicate toughness, low values indicate low toughness.

Figure 2:
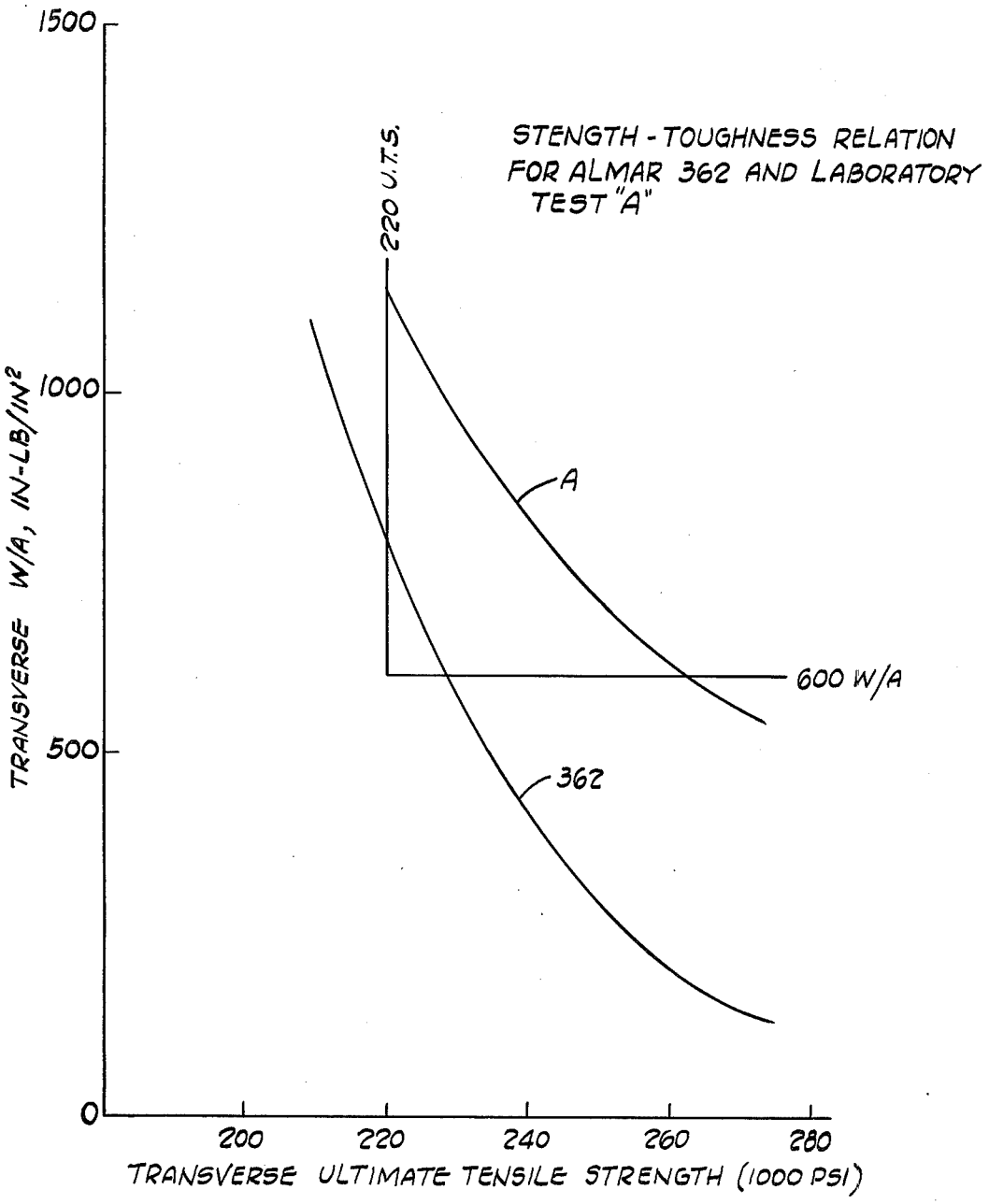
FIG. 2 is a strength-toughness graph contrasting properties of prior materials with materials of the invention.

The strength and toughness criteria required in a tubular stainless steel golf shaft are:

(1) 200,000 psi minimum 0.02% offset yield strength near the tip end of the shaft;
(2) 220,000 psi minimum ultimate tensile strength near said tip end;
(3) 600 minimum in-lbs/in$^2$ toughness near the tip end of the shaft measured in the transverse direction. The small triangle showing properties for Almar 362 and the shaft of the invention are shown in FIG. 2 along with observed variation of strength and toughness as contrasted to the range of shaft "A" of this invention, the range of the strength and toughness was unacceptable.

Attention is directed to U.S. Pat. No. 3,594,158 which covers an alloy having a combination of strength and toughness higher than normal precipitation hardening stainless steels. The material, however, is generally lower in strength than that required by the criteria for the stainless steel as described above.

In the composition of U.S. Pat. No. 3,594,158 a molybdenum addition, purposefully low residuals (carbon, manganese, silicon, phosphorus and sulfur) and tightly controlled amounts of both aluminum and titanium (hardening reaction promoting elements) are used. The sum of aluminum plus titanium content recommended is 0.70% maximum and recommended range on either was 0.05%. The low residuals are stated in said patent to be very low — at levels questionable for electric furnace melting. If the material were required to be produced by vacuum melting in small heats from carefully selected raw materials (and consumable electrode remelting), costs would be very high.

To demonstrate the analysis range suitable for production of high quality stainless steel golf club shafts according to the criteria established:

1. The composition range was determined which would produce the strength and toughness criteria listed above on aged strip.
2. The range of composition was determined for satisfactory shafts from lab heats.

Statistically designed procedure was chosen as a means to minimize the cost of suitable analysis development in a minimum time period.

Testing laboratory heats fabricated in simulation of shaft production to the criteria above, statistical models were generated which showed all properties satisfactory with the following limits.

EXAMPLE I

| C | Mn | Si | Cr | Ni | Mo | Al | Ti | |
|---|---|---|---|---|---|---|---|---|
| .03 Max | .25 Max | .12 Max | 9.75 10.25 | 9.50 10.00 | 1.95 2.25 | .35 .57 | .25 .47 | Balance iron and incidental impurities |

EXAMPLE II

| C | Mn | Si | Cr | Ni | Mo | Al | Ti | |
|---|---|---|---|---|---|---|---|---|
| .06 Max | .50 Max | .30 Max | 9.25 10.25 | 9.00 10.00 | 1.65 2.25 | .30 .75 | .20 .55 | Balance iron and incidental impurities |

It was found that there was no particular criticality of chromium or nickel, and chromium or nickel can vary beyond the ranges listed in the examples above, subject only to maintaining sufficient chromium and molybdenum to resist rusting in air, i.e., about 8.0% and 1.0% respectively, with the sum of chromium, nickel and molybdenum being less than about 25% so that the alloy will have desired strength properties. A production heat fabricated had 11.10% chromium and was entirely satisfactory.

More specifically, particularly preferred steel compositions for use in conjunction with the present invention are the precipitation hardening or maraging stainless steels consisting of: from about 8% to about 12 chromium, from about 1.4% to about 3.25% molybdenum, from about 8% to about 11% nickel, wherein the sum of chromium, molybdenum and nickel ranges from about 18% to about 25%; at least one element selected from the group consisting of aluminum and titanium, not exceeding about 1.30%; carbon in a maximum amount of about 0.06%; manganese in an amount not exceeding about 0.50%; silicon in an amount not exceeding about 0.30%; and, the balance being essentially iron and incidental impurities.

EXAMPLE III

In a similar manner, laboratory heats were made into golf shafts and tested. The pattern made was a long, lightweight "wood" which was a relatively severe test of strength. The results shown in Tables 2 and 3 indicate the relation of strength and toughness to properties. In the shaft of Example 3, a 0.02% offset yield strength even greater than 200,000 psi might be desired to maintain a 0.10 inch maximum permanent deflection in tests.

Table 2

Strength and Tip PD* Data for Age Hardened "A" Shafts Made From Lab Heats

| Heat | Design Heat No. | .02% Y.S. Actual | PD (Greater than 10) | Average Pd |
|---|---|---|---|---|
| 7C672 | 11 | 180.0 | 5/5 | .174 |
| 7C680 | 1 | 193.6 | 5/5 | .384 |
| 7C665 | 19 | 195.3 | 4/5 | .132 |
| 7C675 | 9 | 201.8 | 5/5 | .206 |
| 7c681 | 4 | 207.2 | 3/4 | .130 |
| 7C668 | 2 | 207.2 | 3/3 | .170 |
| 7C664 | 13 | 207.9 | | .050 |
| 7C669 | 3 | 209.2 | 5/5 | .216 |
| 7C682 | 12 | 209.6 | | .084 |
| 7C667 | 10 | 215.3 | 3/5 | .110 |
| 7C685 | 22 | 216.6 | | .069 |
| 7C677 | 5 | 220.7 | | .046 |
| 7C671 | 6 | 222.6 | | .043 |
| 7C674 | 18 | 223.2 | | .082 |
| 7C684 | 21 | 224.3 | | .044 |
| 7C679 | 17 | 225.8 | | .062 |
| 27500 | — | 233.1 | | .074 |
| 7C666 | 16 | 233.2 | | .038 |
| 7C678 | 14 | 234.1 | | .036 |
| 7C686 | 23 | 235.5 | | .032 |
| 7c673 | 15 | 243.7 | | .036 |
| 7C676 | 7 | 244.9 | | .046 |
| 7C683 | 20 | 244.9 | | Not Tested |
| 7C670 | 8 | 249.5 | | .030 |

*Permanent Deflection

Table 3

Toughness and Split Data for Age Hardened "A" Shafts Lab Heats

| Heat | Design Heat No. | W/A | Split |
|---|---|---|---|
| 7C686 | 23 | 336 | 4/4 |
| 7C670 | 8 | 392 | 4/4 |
| 7C671 | 6 | 446 | 3/3 |
| 7C678 | 14 | 480 | 1/4 |
| 7C683 | 20 | 489 | Not Tested |
| 7C666 | 16 | 503 | 1/4 |
| 7C673 | 15 | 521 | 1/4 |
| 7C676 | 7 | 550 | |
| 7C684 | 21 | 574 | |
| 7C664 | 13 | 596 | |
| 7C677 | 5 | 623 | |
| 7C685 | 22 | 634 | |
| 7C674 | 18 | 704 | |
| 7C665 | 19 | 733 | |
| 27500 | — | 747 | Production Heat |
| 7C679 | 17 | 787 | |
| 7C667 | 10 | 810 | |
| 7C672 | 11 | 845 | |
| 7C669 | 3 | 852 | |
| 7C668 | 2 | 864 | |
| 7C682 | 12 | 875 | |
| 7C675 | 9 | 902 | |
| 7C681 | 4 | 969 | |
| 7C680 | 1 | 1023 | |

Permanent deflection (PD) tests as used in the industry were employed to measure the amount of permanent deflection of the shaft samples and these test results are shown in Table 2.

Many thousand shafts were made from production heats Nos. 27500, 29009 and 29848 analyzing:

| | C | Mn | Si | Cr | Ni | Mo | Al | Ti |
|---|---|---|---|---|---|---|---|---|
| 27500 | .021 | .20 | .090 | 11.10 | 9.63 | 1.98 | .48 | .35 |
| 29009 | 0.26 | .21 | .056 | 9.88 | 9.79 | 2.05 | .53 | .28 |
| 29848 | .014 | .12 | .060 | 9.82 | 9.59 | 2.10 | .40 | .43 |

All were satisfactory. Each heat contained a balance of iron and incidental impurities.

The shafts were subjected, as described hereinbefore, to deflection tests and to longitudinal impact testing known as "slap" testing over 70% of the shaft length measured from the tip.

The shafts were further subjected to IZOD impact tests with satisfactory results.

Although the present invention has been described in connection with preferred embodiments, it is to be understood that numerous changes and departures and uses may be made thereof without, however, departing from the spirit of my invention and the scope of the appended claims.

We claim:

1. A tubular golf shaft made from a precipitation hardening or maraging stainless steel consisting of about 8% to 12% chromium, about 1.4% to 3.25% molybdenum, about 8% to 11% nickel, the sum of the chromium molybdenum and nickel being at least 18% and not exceeding 25%, at least one element selected from the group consisting of aluminum and titanium not exceeding 1.30%, carbon in a maximum amount of 0.06%, and manganese 0.50% maximum, and silicon in an amount not exceeding 0.30% maximum, the balance essentially iron and incidental impurities, said steel being in the martensitic form thereof and said shaft exhibiting a 200,000 psi minimum yield strength and toughness of 600 in.-lbs./in.$^2$ measured at or near the tip of the shaft.

2. A tubular golf shaft made from a precipitation hardening or maraging stainless steel consisting of about 8% to 12% chromium, about 1.4% to 3.25% molybdenum, about 8 to 11% nickel, the sum of the chromium, molybdenum and nickel being at least 18% and not exceeding 25%, at least one element selected from the group consisting of aluminum and titanium not exceeding 1.30%, carbon in a maximum amount of 0.06% and manganese 0.50% maximum, and silicon in an amount not exceeding 0.30% maximum, the balance essentially iron and incidental impurities, said shaft having a 200,000 psi minimum 0.02% offset yield strength measured at or near the tip end of the shaft, a 220,000 psi minimum ultimate tensile strength at or near said tip end, and 600 minimum in.-lbs./in.$^2$ toughness at or near the tip end of the shaft measured in the transverse direction.

* * * * *